US007056168B2

(12) United States Patent
Roos

(10) Patent No.: US 7,056,168 B2
(45) Date of Patent: Jun. 6, 2006

(54) OUTBOARD WATERJET

(76) Inventor: Paul W. Roos, 711 NW. 4th Ave., Delray Beach, FL (US) 33444

( * ) Notice: Subject to any disclaimer, the term of this patent is extended or adjusted under 35 U.S.C. 154(b) by 0 days.

(21) Appl. No.: 10/947,956

(22) Filed: Sep. 23, 2004

(65) Prior Publication Data

US 2006/0009094 A1 Jan. 12, 2006

Related U.S. Application Data

(60) Provisional application No. 60/505,452, filed on Sep. 23, 2003.

(51) Int. Cl.
*B63H 11/00* (2006.01)

(52) U.S. Cl. ..... 440/38; 440/53

(58) Field of Classification Search ..... 440/38, 440/40–43, 46, 47, 53
See application file for complete search history.

(56) References Cited

U.S. PATENT DOCUMENTS

| | | | | |
|---|---|---|---|---|
| 4,281,996 | A * | 8/1981 | Mouraret | 440/89 R |
| 4,459,117 | A * | 7/1984 | Jordan | 440/38 |
| 4,538,996 | A * | 9/1985 | Inwood | 440/38 |
| 5,421,753 | A | 6/1995 | Roos | |
| 5,445,545 | A | 8/1995 | Draper | |
| 6,283,805 | B1 * | 9/2001 | Ishigaki | 440/46 |
| 6,692,318 | B1 * | 2/2004 | McBride | 440/38 |

* cited by examiner

*Primary Examiner*—Jesus D. Sotelo
(74) *Attorney, Agent, or Firm*—Jansson, Shupe, Munger & Antaramian, Ltd.

(57) ABSTRACT

An outboard waterjet propulsion system for a marine vessel having a bottom and a transom with a top edge, the propulsion system comprising: an intake duct with grid bars; a motor; an impeller with an impeller hub and driven by the motor; a steering deflector; and a diffusor with a diffusor hub rigidly attached to the intake duct and supporting the steering deflector. The propulsion system is positioned outboard of the vessel against the transom, and vessel steering is achieved by articulation of the steering deflector.

4 Claims, 5 Drawing Sheets

OUTBOARD WATERJET

RELATED APPLICATION

This application is based in part on U.S. Provisional Application No. 60/505,452 filed on Sep. 23, 2003, the contents of which are incorporated herein by reference.

FIELD OF THE INVENTION

This invention relates to waterjet driven-marine vehicles, and more particularly to outboard waterjet propulsion systems for such marine vehicles.

BACKGROUND OF THE INVENTION

Marine waterjets have many benefits for propulsion of marine vessels, such as higher safety, higher efficiency, shallow draft and outstanding maneuverability. However, a disadvantage of conventional waterjet systems is the large amount of space taken up by the motor and the gearbox that are typically placed in front of the waterjet inside the vessel. The motor drives the waterjet via a transmission that adapts the rotational speed of the motor to that of the waterjet. A drive shaft with flexible couplings at each end, a shaft tube, and a water seal connect the transmission to the impeller of the waterjet. The shaft and shaft tube pass through the waterjet intake duct, obstructing the water flow in the intake duct to the impeller, lowering the efficiency of the waterjet. U.S. Pat. No. 5,421,753 shows such a drive arrangement. The placement of the intake duct inside the vessel near the transom requires special tools and skills on the part of the waterjet manufacturer, the vessel manufacturer or retrofitter.

In conventional waterjet systems, the cleaning of the intake grid that protects the waterjet from ingesting debris is often an extremely arduous task simply because it is difficult to reach the intake grid with the waterjet in its permanently-installed position in the vessel.

Conventional outboard motors are generally heavy, noisy, and costly. Much of the cost is associated with the power transmission linkage between the power head and the propeller, and the components of this linkage are of necessity metallic.

Often, users of conventional outboard motors also purchase an electric trolling motor for both convenience and trolling performance. This combination, viewed by most fisherman as a necessity, adds further cost for the user.

In recent years, battery technology has developed rapidly, to the point where the stored energy densities of some batteries make electric propulsion of marine vessels a possibility. Further, advances in semiconductor switching technology enable numerous electric motor developments that would not have been possible in the past.

OBJECTS OF THE INVENTION

It is an object of this invention to provide a waterjet propulsion system for use on all marine vessels that presently can be driven by conventional outboard motors.

Another object of this invention is to increase the efficiency of marine outboard drive units.

Another object of this invention is to provide an outboard propulsion system that is safer than conventional outboard motors.

Another object of this invention is to provide an outboard propulsion system that is lighter and more compact than conventional outboard motors.

Still another object of this invention is to provide an outboard waterjet for marine vessels that is driven by electric power.

Yet another object of this invention is to combine the trolling function with the propulsion function in an outboard waterjet propulsion system.

Another object of this invention is to provide an outboard propulsion system that is quieter than conventional outboard motors.

Another object of the invention is to provide an outboard propulsion system that is easily cleaned by the operator.

Yet another object of this invention is to provide a waterjet propulsion system that avoids all hull penetration by an intake duct.

These and other objects of the invention will be apparent from the following descriptions and from the drawings.

SUMMARY OF THE INVENTION

The invention is an outboard waterjet propulsion system for a marine vessel having a bottom and a transom with a top edge, the propulsion system comprising: an intake duct with grid bars; a motor; an impeller with an impeller hub and driven by the motor; a steering deflector; and a diffusor with a diffusor hub rigidly attached to the intake duct and supporting the steering deflector. The propulsion system is positioned outboard of the vessel against the transom, and vessel steering is achieved by articulation of the steering deflector.

In a preferred embodiment of the invention, the outboard waterjet propulsion system further includes a transom clamp and a mounting bracket for pivotably attaching the waterjet propulsion system to the transom clamp around a horizontal axis near the top edge of the transom.

In another preferred embodiment, the outboard waterjet propulsion system further includes: a lower pivot parallel to a horizontal axis, the lower pivot pivotably supporting the intake duct; a trim adjustor connecting the intake duct to the mounting bracket; and a height adjustor for moving the lower pivot vertically. The vertical position of the propulsion system is adjusted and the trim angle of the propulsion system around the lower pivot is set.

In a highly preferred embodiment of the invention, the outboard waterjet propulsion system also includes a transom adapter attached to the intake duct. The transom adapter is substantially flush to the bottom and provides smooth laminar flow between the bottom at the transom and the intake duct.

In another highly preferred embodiment, the transom adapter includes the intake grid bars and is pivotably attached to the intake duct around a horizontal axis.

In another embodiment of the invention, the motor within the outboard waterjet propulsion system is an internal combustion engine. This embodiment of the invention further includes a drive shaft for transmitting the power output of the engine through the diffuser and a right angle gear assembly being driven by the drive shaft and supporting the impeller with an impeller shaft within at least one of the diffuser hub and the impeller hub. The right angle gear assembly includes at least two bevel gears and at least two bearings supporting the impeller shaft.

In a highly preferred embodiment of the invention, the motor of the outboard waterjet propulsion system is an electric motor. In certain embodiments, the electric motor is internal to at least one of the diffuser hub and impeller hub.

DETAILED DESCRIPTION OF PREFERRED EMBODIMENTS

Figure 1:
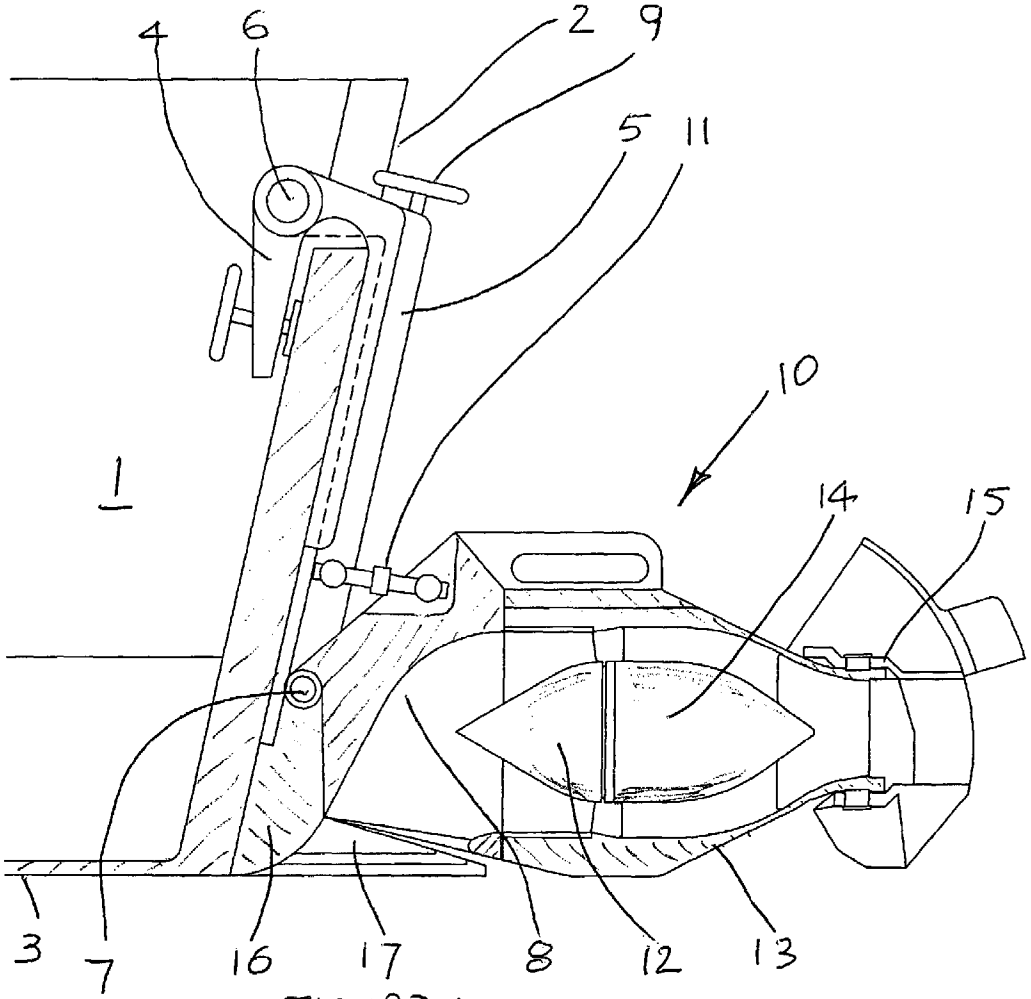
FIG. 1 is a partial section elevation of a marine vessel with one embodiment of the inventive outboard waterjet. The waterjet is driven by an internal electric motor.
Figure 2:
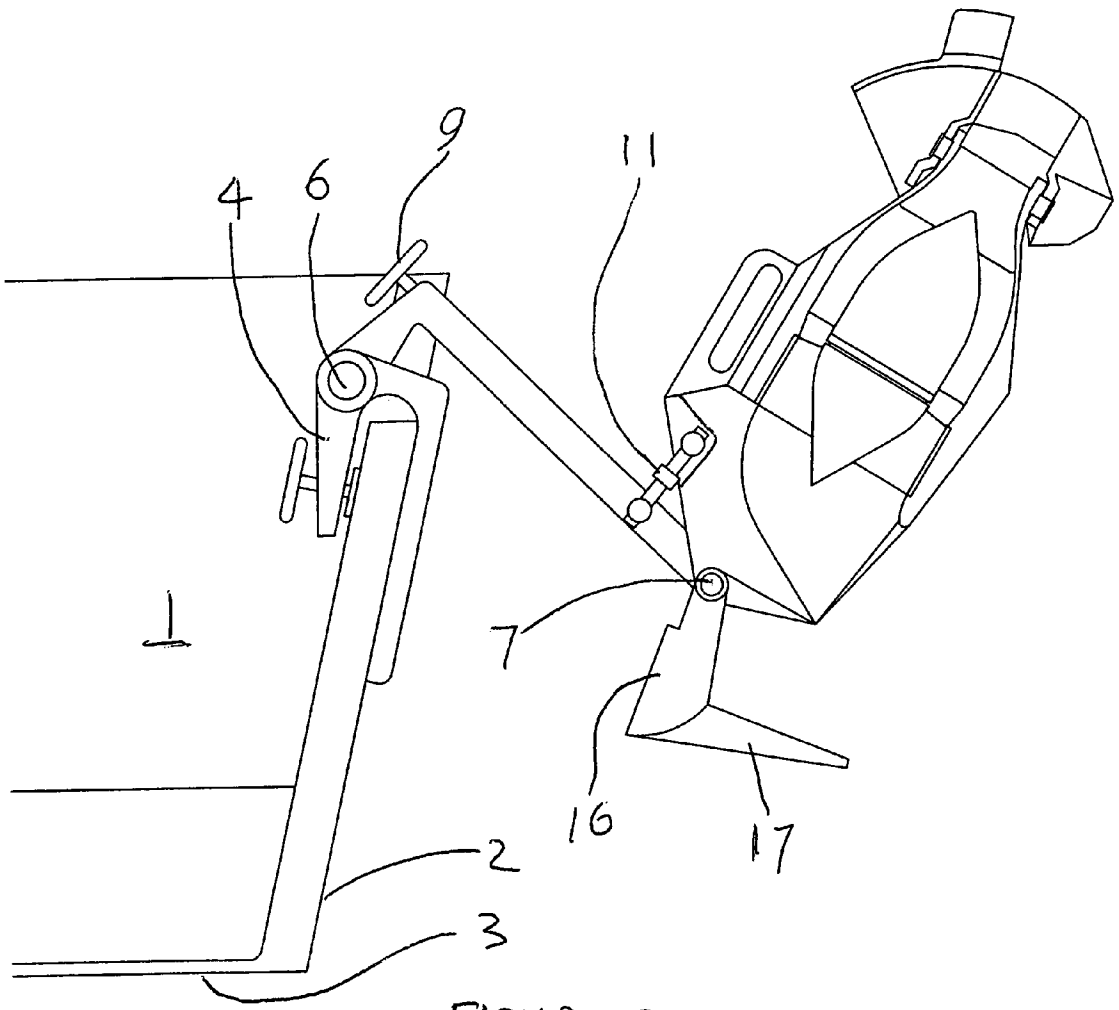
FIG. 2 is a partial section elevation of the vessel and waterjet of FIG. 1 with the waterjet in a raised position.

Referring to FIG. 1, a marine vessel 1 with a transom 2 and a bottom 3 is shown with an outboard waterjet propulsion system 10 mounted on transom 2. System 10 is mounted to transom 2 with a transom clamp 4 and a mounting bracket 5. Mounting bracket 5 is pivotably mounted to transom clamp 4 through a pivot 6 to enable swinging system 10 out of the water when not in use, as illustrated in FIG. 2.

A lower pivot 7 supports an intake duct 8. Pivot 7 is suspended from mounting bracket 5 by a height adjustor 9 and a trim adjustor 11. Height adjustor 9 allows the position of lower pivot 7 to be set relative to bottom 3 of vessel 1. Trim adjustor 11 allows the angular orientation of system 10 to be set relative to transom 2. Such height and angle adjustments permit positioning and orienting system 10 such that the bottom of intake duct 8 aligns with and is substantially flush to bottom 3. In this position and orientation, the flow of water between bottom 3 at transom 2 will be non-turbulent, a condition advantageous for effective waterjet operation.

System 10 pumps water through intake duct 8 through the action of impeller 12 driven by an electric motor (not shown) internal to a diffuser hub (reference number 14 in FIG. 1 in this application) as described in a commonly-owned and concurrently-filed U.S. patent application, Ser. No. 10/947,958, entitled "WATERJET WITH INTERNAL DRIVE MOTOR." The water further passes through a diffuser 13 and exits through a steering deflector 15, thereby providing both thrust and steering to vessel.

Again referring to FIG. 1, a transom adapter 16 is pivotably mounted to intake duct 8 by lower pivot 7. Intake grid bars 17 are attached to transom adapter 16. Grid bars 17 function to avoid the ingestion of debris into system 10. In the raised position as shown in FIG. 2, transom adapter 16 is free to swing on lower pivot 7, thereby allowing release of debris from grid bars 17 and cleaning by the operator.

Figure 3:
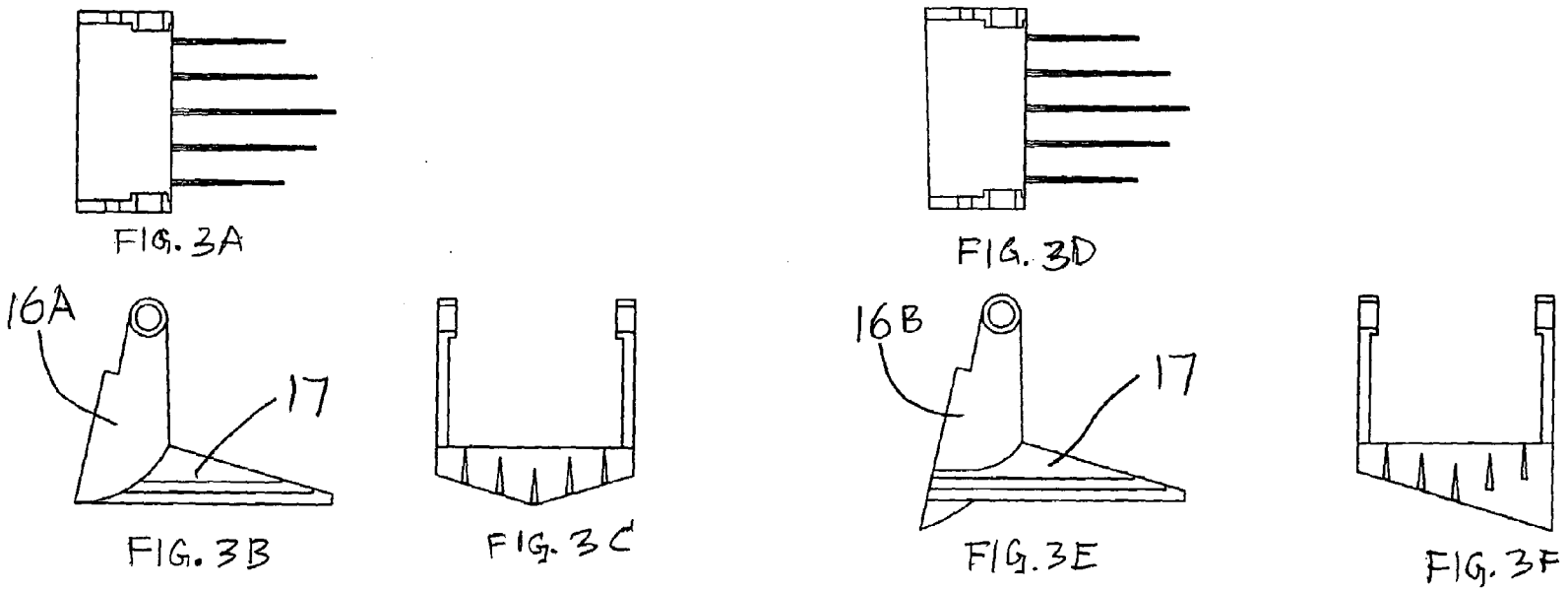
FIGS. 3A through 3F illustrate two embodiments of a transom adapter.

Lower pivot 7 may utilize a removal pin to transom adapter 16 to be removed easily for damage replacement or for adaptation of system 10 to a marine vessel with different bottom geometry. Transom adapter 16 can be made with numerous different geometries to effect this adaptation. As shown in FIG. 3A through 3F, two such different geometries of transom adapter 16 are illustrated. FIG. 3A through 3C depict a transom adapter 16A that is for a propulsion system 10 mounted on the centerline of vessel 1. FIGS. 3D thought 3F depict a transom adapter 16B that is for a propulsion system 10 mounted on the left side (looking forward) of the vessel centerline. In all cases, transom adapters 16 are able to be positioned and oriented to achieve to desired non-turbulent inflow to intake duct 8.

Figure 4:
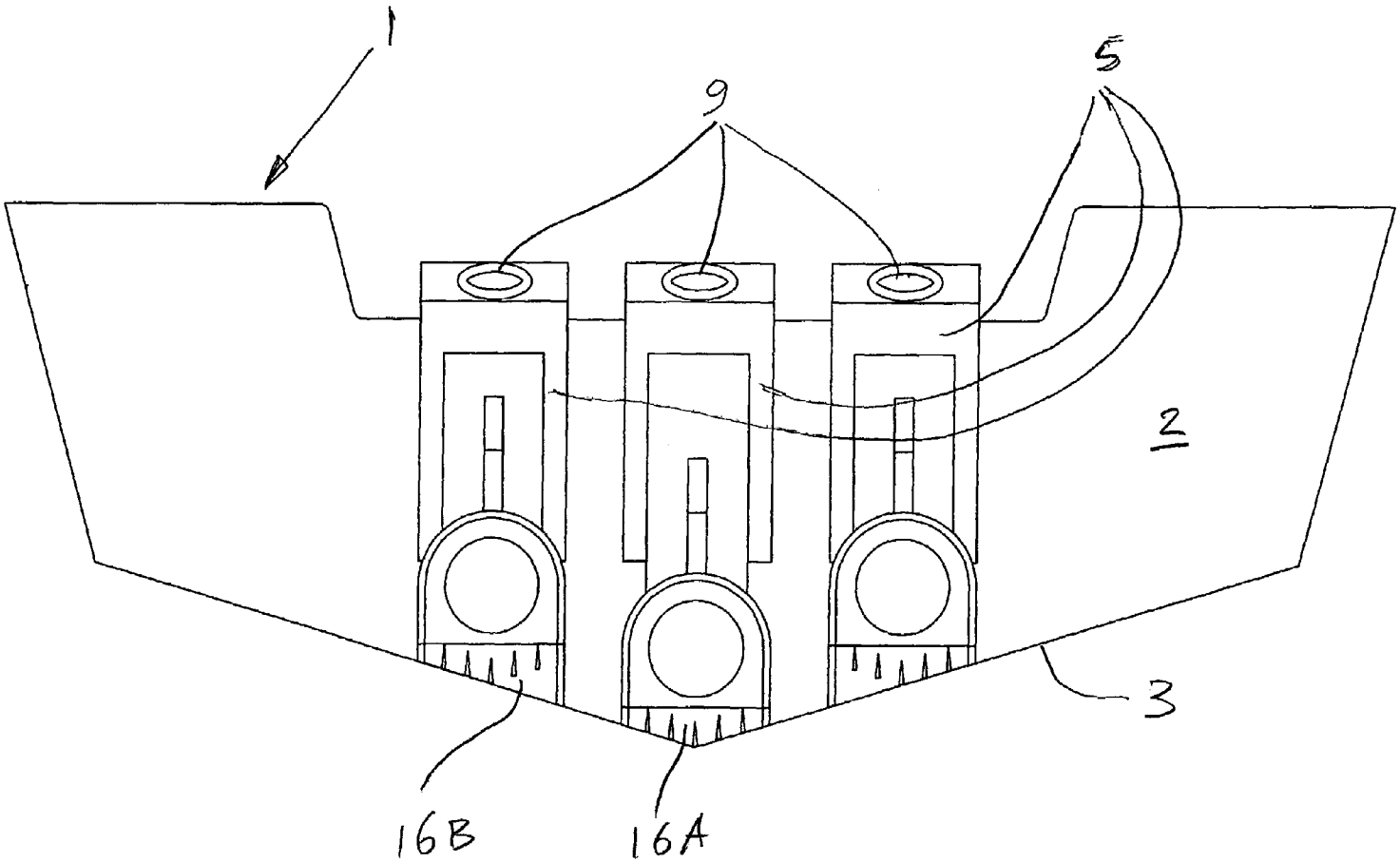
FIG. 4 is a rear view of three waterjet units, including transom adapters, installed on a vessel transom.

FIG. 4 illustrates in a rear view how the two different geometries of transom adapters 16A and 16B adapt to the shape of bottom 3 of vessel 1. Numerous transom adapters can be made to fit marine vessels of all types that are available in the market.

Figure 5:
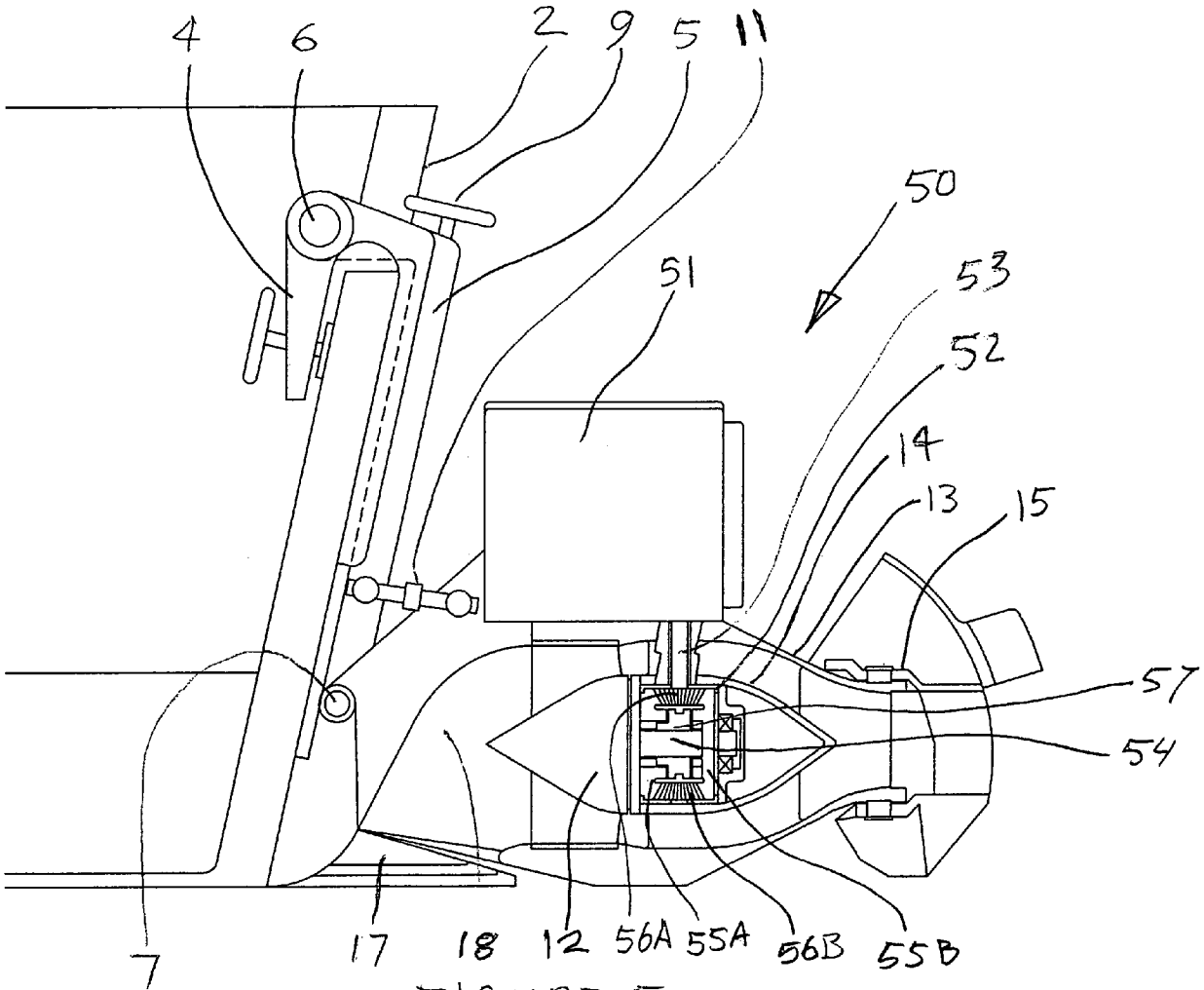
FIG. 5 is a partial section elevation of a second embodiment of the inventive waterjet system with an external motor and the corresponding power transmission configuration.

Referring now to FIG. 5, which is a partial section elevation of a second embodiment of the inventive waterjet system driven by an external motor through a power transmission system. Propulsion system 50 includes external motor 51 which can be an internal combustion engine, an electric motor, or a hydraulic motor. External motor 51 drives impeller 12 through a right angle gear assembly 52, located inside diffuser hub 14, via a drive shaft 53. Drive shaft 53 passes through one side of diffuser 13 and drives an impeller shaft 54 supporting impeller 12.

Right angle gear assembly 52 includes four bevel gears (two bevel pinion gears 56A and 56B and two bevel gears 55A and 55B) to transmit power at a right angle to drive shaft 53. A clutch 57 is located on impeller shaft 54 in a splined fashion to engage either bevel gears 55A or 55B with impeller shaft 54 in order to select forward or reverse flow. Bevel pinion gear 56A is a driven gear, and bevel pinion gear 56B is an idler gear. Reverse flow is used to backwash intake duct 8 and intake grid 17.

While the principles of this invention have been described in connection with specific embodiments, it should be understood clearly that these descriptions are made only by way of example and are not intended to limit the scope of the invention.

The invention claimed is:

1. In an outboard waterjet propulsion system mountable to a marine vessel having a bottom and a transom with a top edge, the propulsion system having: an intake duct with grid bars; a motor; an impeller with an impeller hub driven by the motor; and a diffusor with a diffusor hub rigidly attached to the intake duct, the improvement comprising:

a transom clamp securable to the top edge of the transom;

a mounting bracket having upper and lower ends, the upper end being pivotably attached to the transom clamp for pivoting movement about a horizontal axis parallel and adjacent to the top edge of the transom, a lower pivot parallel to a horizontal axis, the lower pivot pivotably supporting the intake duct on the mounting bracket lower end;

a trim adjustor connecting the intake duct to the mounting bracket; and a height adjustor for moving the lower pivot vertically, whereby the propulsion system is positioned outboard of the vessel against the transom and is pivotable to above the water for cleaning of the intake duct grid bars and whereby the vertical position of the propulsion system is adjusted and the trim angle of the propulsion system around the lower pivot is set.

2. The outboard waterjet propulsion system of claim 1 further including a transom adapter attached to the intake duct, whereby the transom adapter is substantially flush to the bottom and provides smooth laminar flow between the bottom of the vessel at the transom and the intake duct.

3. The outboard waterjet propulsion system of claim 2 wherein the transom adapter includes the intake grid bars.

4. The outboard waterjet propulsion system of claim 2 wherein the transom adapter is pivotably attached to the intake duct around a horizontal axis.

* * * * *